US005271419A

United States Patent [19]

Arzonico et al.

[11] Patent Number: 5,271,419

[45] Date of Patent: * Dec. 21, 1993

[54] CIGARETTE

[75] Inventors: Barbara W. Arzonico, Lewisville; Richard L. Blakley, Pfafftown; Sharon P. Dunlap, Walnut Cove; Jeffery S. Gentry, Pfafftown; Kathy A. Hege, Advance; Mark L. Raker, Clemmons; Gary R. Shelar, Greensboro, all of N.C.

[73] Assignee: R. J. Reynolds Tobacco Company, Winston-Salem, N.C.

[ * ] Notice: The portion of the term of this patent subsequent to Nov. 16, 2010 has been disclaimed.

[21] Appl. No.: 759,266

[22] Filed: Sep. 13, 1991

Related U.S. Application Data

[63] Continuation-in-part of Ser. No. 414,833, Sep. 29, 1989, Pat. No. 5,074,321, and a continuation-in-part of Ser. No. 661,747, Feb. 27, 1991.

[51] Int. Cl.[5] ..... A24D 1/02

[52] U.S. Cl. ..... 131/365; 131/364; 131/336

[58] Field of Search ..... 131/365, 364, 335, 336

[56] References Cited

U.S. PATENT DOCUMENTS

| | | | |
|---|---|---|---|
| 3,648,711 | 3/1972 | Berger et al. | 131/210 X |
| 3,894,545 | 7/1975 | Crellin et al. | 131/207 X |
| 4,062,368 | 12/1977 | Crellin et al. | 131/207 X |
| 5,074,321 | 12/1991 | Gentry et al. | 131/365 X |
| 5,137,034 | 8/1992 | Perfetti et al. | 131/335 X |

*Primary Examiner*—V. Millin
*Assistant Examiner*—J. Doyle

[57] ABSTRACT

A cigarette includes a charge or roll of smokable material (e.g., tobacco cut filler) circumscribed by two layers of paper wrapping materials. The first or inner wrapping material includes an inorganic filler material and tobacco material within the web. The inner wrapping material also can include a water soluble salt burn chemical and a carbonaceous material within the web. The second or outer wrapping material circumscribes and overwraps the first wrapping material, has a cellulosic base web and inorganic filler material, and exhibits a low inherent air permeability. The outer wrapping material can include a magnesium hydroxide filler, and exhibits an inherent air permeability of below about 15 CORESTA units and a net air permeability above about 40 CORESTA units. The cigarette is capable of sustaining smolder under FTC smoking conditions while yielding very low levels of visible sidestream smoke. The cigarette includes a filter element having 2 or more longitudinally positioned segments, and one of the segments includes a carbonaceous material.

25 Claims, 2 Drawing Sheets

CIGARETTE

CROSS REFERENCE TO RELATED APPLICATIONS

This is a continuation-in-part of co-pending U.S. patent application Ser. No. 414,833, filed Sep. 29, 1989, now U.S. Pat. No. 5,074,321 and U.S. patent application Ser. No. 661,747, filed Feb. 27, 1991, still pending.

BACKGROUND OF THE INVENTION

The present invention relates to cigarettes which burn tobacco, and in particular to cigarettes, which when smoked, generate low amounts of sidestream "tar" and sustain smolder at least during FTC smoking conditions.

Popular smoking articles, such as cigarettes, have a substantially cylindrical rod shaped structure and include a charge of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco rod. Typically, a filter element includes cellulose acetate tow circumscribed by plug wrap, and is attached to the tobacco rod using a circumscribing tipping material. It also has become desirable to perforate the tipping material and plug wrap, in order to provide dilution of drawn mainstream smoke with ambient air.

Cigarettes are employed by the smoker by lighting one end thereof and burning the tobacco rod. The smoker then receives mainstream smoke into his/her mouth by drawing on the opposite end (e.g., the filter end) of the cigarette. During the time that the cigarette is not being drawn upon by the smoker, it remains burning, and sidestream smoke is generated. Sidestream smoke is smoke which directly enters the atmosphere from the lit end of the cigarette. Sidestream smoke diffuses into the atmosphere, and the characteristic visible nature thereof may be perceived negatively by some individuals. Thus, certain cigarette smokers have indicated a desire to decrease the levels of visible sidestream smoke generated by their cigarettes.

The relative amount of visible sidestream smoke generated by a burning cigarette is related to the amount of sidestream "tar" generated by that burning cigarette. Typical cigarettes of about 84 mm length (e.g., having a tobacco rod length of about 57 mm and a filter element length of about 27 mm) often yield about 25 to about 35 mg of sidestream "tar" per cigarette. See, Proctor, et al., *Analyst*, Vol. 113, p. 1509 (1988), for an apparatus and technique for determining the sidestream "tar" of a cigarette.

Numerous cigarettes which reportedly yield relatively low levels of visible sidestream smoke have been proposed. See, for example, U.S. Pat. Nos. 4,108,151 to Martin; 4,225,636 to Cline; 4,231,377 to Cline; 4,407,308 to Baker; 4,420,002 to Cline; 4,450,847 to Owens; 4,461,311 to Mathews; 4,561,454 to Guess; 4,624,268 to Baker, et al.; 4,637,410 to Luke; 4,805,644 to Hampl, Jr., et al.; 4,881,557 to Martin; 4,915,118 to Kaufman, et al.; 4,924,888 to Perfetti, et al.; 4,941,485 to Perfetti, et al. and 4,998,541 to Perfetti, et al.; as well as European Patent Application No. 402,059.

It would be desirable for the cigarette manufacturer to provide a good tasting cigarette which (i) provides good smoking satisfaction, (ii) sustains smolder at least during FTC smoking conditions, and (iii) generates low levels of sidestream "tar" and hence low levels of visible sidestream smoke.

SUMMARY OF THE INVENTION

The present invention relates to a cigarette which delivers good tobacco flavor, pleasure and satisfaction while generating relatively low levels of sidestream "tar." Such cigarettes also exhibit extremely low levels of visible sidestream smoke as well as low levels of sidestream odor. Cigarettes of the present invention (i) have a weight which is not overly excessive, (ii) yield an acceptable ash and fire cone, (iii) yield acceptable smolder properties, and (iv) yield a burn rate which is acceptable. Further, such cigarettes have a tendency to (i) burn back uniformly during use, and (ii) not provide visible staining of the outer wrap immediately behind the char line during use. Preferred cigarettes burn back slowly during static smolder resulting in the combustion of a relatively low amount of smokable material, while maintaining a tendency to sustain smolder.

Cigarettes of the present invention include a charge or roll of smokable material contained in two layers of circumscribing outer wrapping materials to form a so-called "tobacco rod." The tobacco rod is such that a first (i.e., inner) wrapping material circumscribes the smokable material, and a second (i.e., outer) wrapping material circumscribes the first wrapping material. The smokable material is a smokable filler material comprising tobacco cut filler material. Normally, the smokable material is all tobacco cut filler material, and preferably that cut filler material has been cased and/or top dressed.

The second or outer layer of wrapping material surrounding the roll of smokable material is a paper which most preferably has a relatively low inherent air permeability. Wrapping materials having a low inherent air permeability or low porosity typically exhibit a porosity or air permeability below about 15 CORESTA units, normally below about 10 CORESTA units, often below about 8 CORESTA units, and frequently about 5 CORESTA units or less. A CORESTA unit is a measure of the linear air velocity which passes through a 1 $cm^2$ area of wrapper at a constant pressure of 1 centibar. See CORESTA Publication ISO/TC 126/SC 1 N159E (1986). The second wrapping material most preferably has a net porosity which is greater than the inherent porosity thereof, particularly when that wrapping material includes a magnesium hydroxide filler. Typically, the second wrapping material is perforated (e.g., electrostatically perforated) to have a net porosity of about 50 to about 225 CORESTA units.

The first or inner wrapping material surrounding the roll of smokable material most preferably is a paper containing a tobacco material. The first wrapping material preferably has a sufficiently high level of at least one salt additive which can act to sustain static burn of the tobacco rod, at least when such cigarettes are smoked under FTC smoking conditions. The salt can be an essentially water insoluble inorganic salt (e.g., particles of calcium carbonate), a water soluble inorganic salt (e.g., potassium chloride), or a water soluble salt (e.g., potassium citrate). Mixtures of essentially water insoluble and water soluble salts can be employed. Certain first wrapping materials can contain a carbonaceous material. The first wrapping material most preferably exhibits an inherent air permeability above about 20 CORESTA units. The first wrapping material can be perforated to yield a wrapping material having yet higher net porosity.

Cigarettes of the present invention each include a filter element which acts as a mouthpiece. The filter element includes a carbonaceous material. The filter element preferably includes 2 or more filter segments which are longitudinally positioned within the filter element; and at least one of the filter segments includes a carbonaceous material (e.g., an activated carbon material or an activated charcoal material in a particulate or granular form).

Cigarettes can be air diluted (e.g., by perforating the tipping material in the region which overlies the filter elements or by other such air dilution means). Normally, preferred cigarettes employ moderate to low efficiency filter elements. See, Keith in Schemeltz's *The Chemistry of Tobacco and Tobacco Smoke*, p. 157 (1972). Normally, the filter element is ventilated to provide a cigarette having an air dilution between about 25 and about 75 percent. As used herein, the term "air dilution" is the ratio (expressed as a percentage) of the volume of air drawn through the air dilution means to the total volume of air and smoke drawn through the cigarette and exiting the extreme mouthend portion of the cigarette. See, Selke, et al., *Beitr. Zur Tabak. In.*, Vol. 4, p. 193 (1978).

DETAILED DESCRIPTION OF THE PREFERRED EMBODIMENTS

Figure 1:
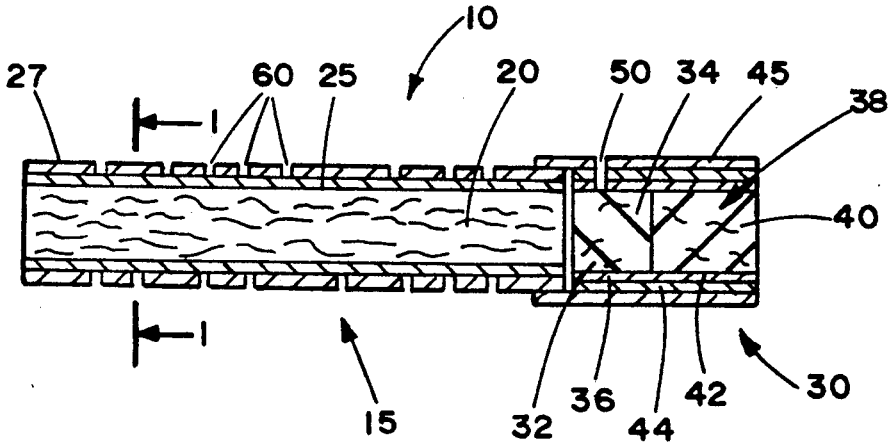
FIG. 1 is a longitudinal sectional view of a cigarette of the present invention.

A preferred embodiment of a cigarette of the present invention is shown in FIG. 1. The cigarette 10 includes a generally cylindrical rod 15 of smokable material 20, such as tobacco cut filler, contained in a first circumscribing inner wrapping material 25 and a second or outer wrapping material 27 circumscribing the first wrapping material. The first and second circumscribing wrapping materials directly contact one another (i.e., the inner surface of the outer wrapping material contacts the outer surface of the inner wrapping material). As such, the outer wrapping material overwraps the inner wrapping material. The rod 15 is hereinafter referred to as a "tobacco rod." The ends of the tobacco rod 15 are open to expose the smokable material.

The cigarette 10 also includes a filter element 30 positioned adjacent one end of the tobacco rod 15 such that the filter element and tobacco rod are axially aligned in an end-to-end relationship, preferably abutting one another. Filter element 30 has a generally cylindrical shape, and the diameter thereof is essentially equal to the diameter of the tobacco rod. The ends of the filter element are open to permit the passage of air and smoke therethrough.

The filter element includes two filter segments which are aligned in an end-to-end relationship, preferably abutting one another. A first filter segment 32 is positioned adjacent the tobacco rod; and includes a first filter material 34, such as a gathered carbon paper or cellulose acetate tow having carbonaceous particles dispersed therein. The first filter material 34 is circumscribed by a wrapping material 36, such as paper plug wrap. A second filter segment 38 is positioned at the extreme mouthend of the cigarette; and includes a second filter material 40, such as gathered cellulose acetate web, plasticized cellulose acetate tow, gathered polyester web, gathered polypropylene web or polypropylene tow. The second filter material 40 is circumscribed by a wrapping material 42, such as a paper plug wrap. The second filter material 40 provides an aesthetically pleasing, white appearance. Each of the filter segments is manufactured using known filter rod making machinery. The two segments are combined using known plug tube combining techniques (e.g., using a Mulfi from Hauni-Werke Korber & Co., K.G.), and are held together using circumscribing outer wrapping material 44 (e.g., paper plug wrap) so as to form the filter element 30.

The filter element 30 is attached to the tobacco rod 15 by tipping material 45 which circumscribes both the entire length of the filter element and an adjacent region of the tobacco rod. The inner surface of the tipping material 45 is fixedly secured to the outer surface of the outer plug wrap 44 and the outer surface of the wrapping material 25 of the tobacco rod, using a suitable adhesive. A ventilated or air diluted smoking article is provided with an air dilution means, such as a series of perforations 50, each of which extend through the tipping material and plug wrap.

Figure 2:
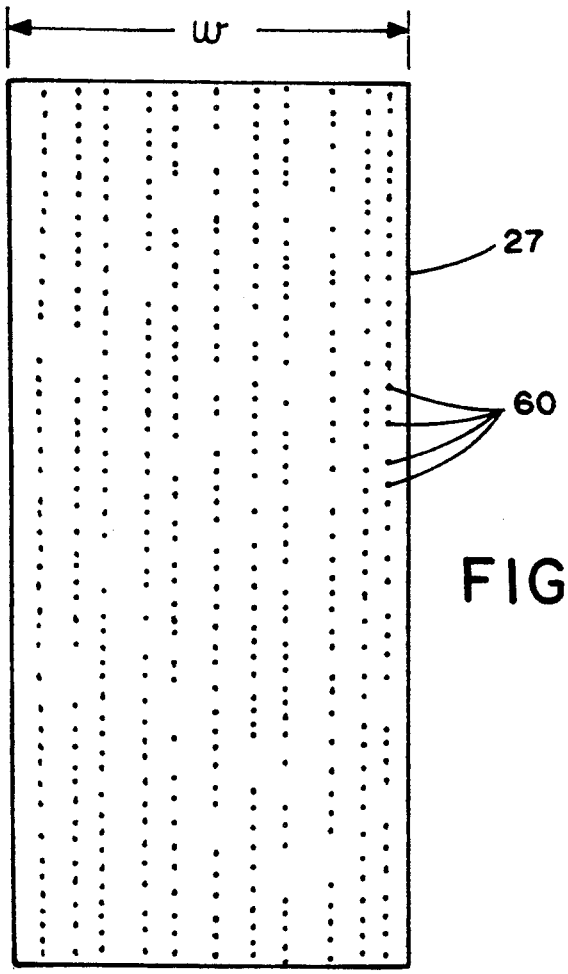
FIG. 2 is a diagrammatic illustration of one type of wrapping material which can be employed to provide a tobacco rod of the present invention.

Referring to FIGS. 1 and 2, one type of outer wrapping material 27 has a width w (shown in FIG. 2) which is equal to the circumference of the cigarette plus the lap zone of the glue line which ultimately results during cigarette manufacture. The preferred second wrapping material 27 includes a series of perforations 60 which extend in a linear fashion along the longitudinal length of thereof. Alternatively, other configurations, such as a random perforation pattern, can be provided. The size, number and relative positioning of the individual perforations 60 can vary depending upon the desired characteristics of the cigarette which has the wrapping material incorporated therein. The individual perforations are shown as enlarged in FIGS. 1 and 2.

Figure 1A:
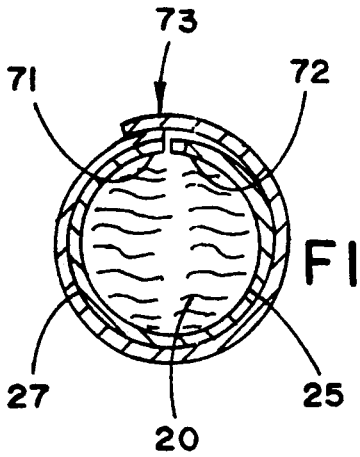
FIGS. 1A and 1B are cross-sectional radial views of the cigarette shown in FIG. 1 taken along lines 1—1 in FIG. 1.

Referring to FIG. 1A, smokable material 20 is contained in a first circumscribing inner wrapping material 25, and a second outer wrapping material 27 circumscribes the first wrapping material. The first wrapping material 25 is formed into a circular shape such that the ends 71, 72 of the sides thereof abut one another. The ends 71, 72 of wrapping material 25 can abut one another (as shown in FIG. 1A), nearly abut one another, or slightly overlap one another. The second wrapping material 27 includes a lap zone 73 including a suitable adhesive therebetween so as to form a secure outer wrapper. As such, the width of the inner wrapping material is less than that of the outer wrapping material. A cigarette rod having such a configuration can be provided by supplying paper wrappers from two bobbins on a suitably equipped cigarette making machine, positioning the inner wrapping material on top of the outer wrapping material, passing the two wrapping materials so positioned through the garniture region of the cigarette making machine, and forming the tobacco rod. Equipment for providing a cigarette in such a manner is described in U.S. patent application Ser. No. 609,975, filed Nov. 6, 1990, and U.S. patent application Ser No. 756,023, filed Sep. 6, 1991, which are incorporated herein by reference. Other equipment for manufacturing a cigarette in such a manner will be apparent to the skilled artisan.

Figure 1B:
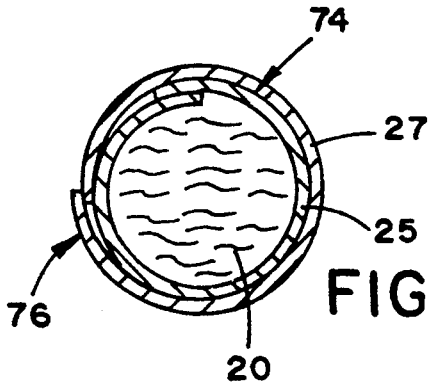

Referring to FIG. 1B, smokable material 20 is contained in a first circumscribing inner wrapping material 25, and a second outer wrapping material 27 circumscribes the first wrapping material. The first wrapping material 25 is formed into a circular shape such that a lap zone 74 including a suitable adhesive therebetween is formed. The second wrapping material includes a lap zone 76 including a suitable adhesive therebetween so as to form a secure outer wrapper. A cigarette rod having such a configuration can be provided by forming a cigarette rod using known techniques, and then wrapping the rod so formed with an outer wrapping material. Equipment for providing such a cigarette will be apparent to the skilled artisan.

Figure 3:
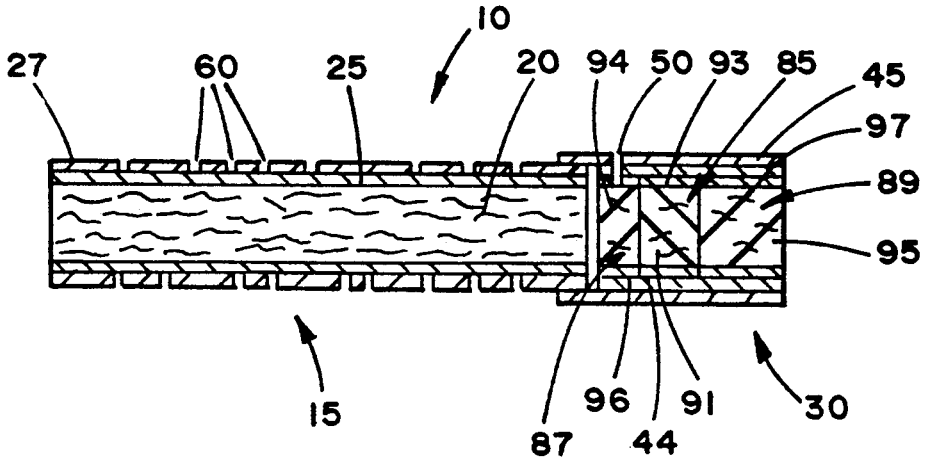
FIG. 3 is a longitudinal sectional view of a cigarette of the present invention.

Another preferred embodiment of a cigarette of the present invention is shown in FIG. 3. The cigarette 10 is generally similar to the cigarette described with reference to FIGS. 1, 1A, 1B and 2, except that the filter element 30 includes 3 filter segments which are aligned in an end-to-end relationship, preferably abutting one another. Such a filter element has a so-called "triple filter" configuration. Center filter segment 85, positioned between rod end filter segment 87 and mouthend segment 89, includes a filter material 91, such as particulate carbonaceous material, gathered carbon paper or cellulose acetate tow having carbonaceous particles dispersed therein. The filter element 30 can be a so-called "cavity filter" containing a segment of carbonaceous particles, but typically, the filter material 91 of the center segment is circumscribed by a wrapping material 93, such as paper plug wrap. The rod end and mouthend filter segments 87, 89 each include filter material 94, 95, respectively. The filter materials 94, 95 typically are materials such as gathered cellulose acetate web, plasticized cellulose acetate tow, gathered polypropylene web, gathered polyester web, or polypropylene tow. The filter materials of each of the rod end and mouth end filter segments can be the same as or different from one another. The filter materials 94, 95 each are circumscribed by wrapping material 96, 97, respectively. The three filter segments are held together using circumscribing outer wrapping material 44 so as to form the filter element 30.

The smokable material employed in the manufacture of the tobacco rod can vary. For example, the smokable material of the cigarette can have the form of filler (e.g., tobacco cut filler). As used herein, the terms "filler" or "cut filler" are meant to include tobacco materials and other smokable materials which have a form suitable for use in the manufacture of tobacco rods for cigarettes. As such, filler can include smokable materials which are blended and are in a form ready for cigarette manufacture. The filler materials normally are employed in the form of strands or shreds as is common in conventional cigarette manufacture. For example, the cut filler material can be employed in the form of strands or shreds from sheet-like or "strip" materials which are cut into widths ranging from about 1/20 inch to about 1/60 inch, preferably from about 1/25 inch to about 1/35 inch. Generally, such strands or shreds have lengths which range from about 0.25 inch to about 3 inches.

Examples of suitable types of tobacco materials include flue-cured, Burley, Maryland or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut-puffed stems, reconstituted tobacco materials; or blends thereof. Certain reconstituted tobacco materials are described in U.S. Pat. No. 4,987,906 to Young, et al.; in European Patent Application No. 419,733; and in U.S. patent application Ser. Nos. 416,332, filed Sep. 29, 1989 now U.S. Pat. No. 5,056,537; 647,329, filed Jan. 28, 1991; and 710,273, filed Jun. 4, 1991. Certain processed tobacco materials are described in U.S. Pat. No. 5,025,812 to Fagg, et al.; and U.S. patent application Ser. No. 484,587, filed Feb. 23, 1990 now U.S. Pat. No. 5,065,775. Certain blends are described in U.S. Pat. Nos. 4,924,888 to Perfetti, et al.; 4,942,888 to Montoya, et al.; and 4,998,541 to Perfetti, et al. Preferably, the smokable material or blend of smokable materials consists essentially of tobacco filler material or consists only of tobacco filler material.

Smokable materials can be cased and top dressed as is conventionally performed during various stages of cigarette manufacture. As such, the smokable material, and particularly tobacco filler material, can include casing and/or top dressing components. For example, blend components such as flavoring agents and humectants, as well as other forms of tobacco (e.g., tobacco extracts), can be applied to the smokable material, as is commonly performed when cigarettes are manufactured. See, Leffingwell, et al., *Tobacco Flavoring For Smoking Products* (1972). Suitable flavoring agents and forms of tobacco include vanillin, tobacco extracts such as tobacco essences and tobacco aroma oils, cocoa, licorice, menthol, and the like. Flavor modifying agents such as levulinic acid can be applied to the smokable material (e.g., in amounts ranging from about 0.01 to about 2 percent, normally from about 0.1 to about 1 percent, preferably about 0.2 to about 0.6 percent, based on the dry weight of the smokable material). Such components conveniently are applied to the smokable material as casing and top dressing components. See, U.S. Pat. No. 4,830,028 to Lawson, et al.

Typically, the tobacco rod has a length which ranges from about 35 mm to about 85 mm, preferably about 40 to about 70 mm; and a circumference of about 17 mm to about 27 mm, preferably about 22.5 mm to about 25 mm. Short cigarette rods (i.e., having lengths from about 35 mm to about 50 mm) can be employed, particularly when smokable blends having a relatively high packing density are employed.

The packing densities of the blend of smokable materials contained within the wrapping materials can vary. Typical packing densities for tobacco rods of cigarettes of the present invention range from about 150 to about 300 mg/cm$^3$. Normally, packing densities of the tobacco rods range from about 200 to about 280 mg/cm$^3$.

The second or outer wrapping material most preferably is a cigarette wrapping material having a low inherent air permeability value. By the term "inherent permeability" is meant the air flow porosity of the wrapping material itself. For example, such wrapping materials have inherent air permeabilities of less than about 15 CORESTA units, normally less than about 10 CORESTA units, generally less than about 8 CORESTA units, sometimes less than about 5 CORESTA units, often less than about 3 CORESTA units, and frequently less than about 1 CORESTA unit. Such wrapping materials include a cellulosic base web (e.g., provided from wood pulp and/or flax fibers) and inorganic filler material (e.g., magnesium hydroxide filler and calcium carbonate particles). If desired, the cellulosic base web can include tobacco parts or pieces (e.g., tobacco stem parts), extracted tobacco parts or pieces (e.g., tobacco pulp) or bleached tobacco parts or pieces. If desired, tobacco extract can be incorporated into the outer wrapping material.

The second wrapping material preferably is processed in order to have a relatively high net permeability (e.g., a net permeability above about 40, and preferably above about 50 CORESTA units). By the term "net permeability" is meant the air flow porosity of the wrapping material as used in manufacturing the tobacco rod. Typically, the air permeability is provided to the wrapping material using micro laser, mechanical or electrostatic perforation techniques. During micro laser and electrostatic perforation operations, it is most desirable that care be taken to maintain the desired color and opacity of the paper. For example, it is most desirable to minimize or avoid an unsightly "browning" or singeing of the paper. For example, second wrapping materials having low inherent permeabilities can be perforated using conventional electrostatic perforating techniques (e.g., to provide individual perforations comparable in size to conventional electrostatically provided perforations) to obtain a wrapping material having a net porosity of from about 50 to about 225 CORESTA units, preferably from about 80 to about 180 CORESTA units, more preferably from about 90 to about 120 CORESTA units.

The sizes of the individual perforations which provide for the high net permeabilities to the outer wrapping materials generally are such that the perforations are larger than the pores which are present in the naturally occurring paper wrapping material (i.e., which provide the inherent permeability to the paper). For aesthetic purposes, the individual perforations preferably are small enough to not be unsightly. For example, the perforations are not particularly noticeable, and in most instances are barely visible to the naked eye.

Typical outer wrapping materials are paper wrapping materials which contain about 50 to about 75, preferably about 55 to about 70 weight percent cellulosic material; and about 25 to about 50, preferably about 30 to about 45 weight percent inorganic filler. Often desirable paper wrapping materials contain more than about 5, and frequently more than about 7 percent by weight of magnesium hydroxide filler. Preferred paper wrapping materials contain from about 8 to about 35 percent, often about 10 to about 30 percent, and sometimes about 20 to about 30 percent, by weight of magnesium hydroxide. Examples of suitable materials are described by U.S. Pat. Nos. 4,450,847 to Owens, 4,881,557 to Martin and 4,915,118 to Kaufman, et al. The preferred wrapping materials also contain other inorganic fillers, such as calcium carbonate. Preferred paper wrapping materials contain about 5 to about 35 percent, more often about 10 to about 20 percent, by weight of calcium carbonate. Other materials, such as magnesium oxide particles, calcium sulfate fibers, particles of carbonaceous materials, and the like, can be incorporated into the wrapping material. The preferred papers also contain flax fibers, wood pulp, or other cellulosic materials to provide a cellulosic base web. Preferred papers containing magnesium hydroxide filler have relatively high basis weights. Typical basis weights are at least about 30 $g/m^2$, often are greater than about 40 $g/m^2$, and frequently are greater than about 45 $g/m^2$. Typical basis weights do not exceed about 80 $g/m^2$.

A second paper wrapping material having magnesium hydroxide filler preferably includes at least one water soluble alkali metal salt. Examples of water soluble alkali metal salts include potassium malate, potassium acetate, potassium nitrate, potassium citrate, potassium chloride, potassium succinate, potassium propionate, potassium formate, and the like, as well as mixtures thereof. It is preferable that at least a portion of the alkali metal be provided in the form of a salt exhibiting a very low hygroscopic character. An example of such a salt is potassium chloride. The manner in which the water soluble alkali metal salt is incorporated into the second paper wrapping material can vary. The salt can be incorporated into the paper during the manufacturing process. Alternatively, the salt can be incorporated into the paper using size press techniques, printing techniques, painting techniques, or the like. Such techniques will be apparent to the skilled artisan. It is highly preferred that the salt be incorporated into the paper in an essentially uniform manner throughout the paper. The various water soluble salts can be incorporated into the paper simultaneously, or at different processing stages or after paper manufacture.

Although the amount of water soluble alkali metal salt incorporated into the second paper wrapping material having magnesium hydroxide filler can vary, the amount of such salt normally is such that the amount of that salt provides at least about 10 mg, and generally at least about 30 mg water soluble alkali metal ions per gram of dry base web. The amount of water soluble alkali metal salts incorporated into the paper normally is such that those salts provide at least about 35 mg, and frequently at least about 40 mg, water soluble alkali metal ions per gram of dry base web. The amount of water soluble alkali metal salts incorporated into the paper normally is such that those salts provide less than about 90 mg, and frequently less than about 80 mg, water soluble alkali metal ions per gram of dry base web. The level of potassium ions within the second paper wrapping material normally is significantly greater than the level of sodium ions within the paper. In particular, the weight ratio of potassium ions to sodium ions within the paper preferably is greater than about 100:1, preferably greater than about 150:1, more preferably greater than about 200:1.

The second paper wrapping material having magnesium hydroxide filler preferably has at least one organic acid or inorganic acid applied thereto in a non-disassociated form. The acid normally is applied to finished paper using size press or printing techniques. Examples of organic acids include malic, citric, levulinic, fumaric, oxalic and tartaric acids, as well as blends thereof. Examples of inorganic acids include hydrochloric, phosphoric, sulphuric and boric acids, as well as blends thereof. Mixtures of organic and inorganic acids can be employed. It is often preferable to apply the acid to the finished paper by dissolving or dispersing the acid in alcohol or water, and applying the resulting solution or dispersion to the paper. Typically, sufficient acid is applied to the paper to provide a paper having greater than about 0.2 percent, preferably greater than about 0.3 percent, more preferably greater than about 0.4 percent of that acid, based on the dry weight of that paper. Typically, the amount of acid applied to the paper is less than about 6 percent, usually less than about 4 percent, based on the dry weight of that paper. Although the acid is applied to the paper in a non-disassociated (i.e., acid) form, a certain amount of the acid can be present within the paper in a disassociated (i.e., salt) form. As used herein and only for purposes of the present invention, the term "non-disassociated" in referring to the acid is meant that the acid is not in a form of a salt (e.g., a sodium, potassium, calcium or magnesium salt). The acid can be incorporated into the second paper wrapping material together with the alkali metal salt. For example, potassium hydroxide can be contacted with a stoichiometric excess of malic acid in water, and the resulting solution of potassium malate and malic acid can be applied to the wrapping material using a size press. Preferred paper wrapping materials incorporate at least about 0.4, more preferably greater than about 1, and most preferably greater than about 2 weight percent malate ion (e.g., provided as potassium malate and malic acid).

The second paper wrapping material having magnesium hydroxide filler optionally can have at least one sugar applied thereto. Examples of sugars include sucrose, glucose, fructose, dextrose and maltose. The sugar normally is applied to the finished paper using size press or printing techniques. It is often preferable to apply the sugar to the finished paper by dissolving the sugar in an aqueous liquid (e.g., along with the previously described alkali metal salt), and applying the resulting solution to the paper. When employed, the sugar is applied to the paper in an amount up to about 12 percent, preferably about 0.5 to about 8 percent, more preferably about 1 to 5 percent, based on the dry weight of the paper.

Examples of suitable outer paper wrapping materials are available as Ecusta Experimental Paper Nos. TOD 05504, TOD 05405, TOD 05273, TOD 05275, TOD 05375, TOD 05759, TOD 05721, TOD 05560, TOD 05505, TOD 05386, TOD 05390, TOD 05422, TOD 05387, TOD 05551, TOD 05151, TOD 05365, TOD 05992, TOD 05962, TOD 05963, TOD 05969 and TOD 05943 from Ecusta Corp.

Another suitable second wrapping material is a cigarette paper consisting essentially of calcium carbonate and flax. Suitable second wrapping materials are available as P-2123-0101 and P-2123-0103 from Kimberly-Clark Corp. and as Reference No. TOD 03816 from Ecusta Corp. Also suitable are cigarette papers manufactured from wood pulp and inorganic fillers such as calcium carbonate. An example of such a paper is available as P-2540-21 from Kimberly-Clark Corp. Certain preferred second or outer wrapping materials include an amount of at least one polymeric film forming agent sufficient to provide a desirably low inherent permeability. For example, a sufficient amount of polymeric film forming agent can be applied to a paper wrapper having an air permeability of from about 10 to about 30 CORESTA units to provide a paper having an inherent air permeability of less than about 8 CORESTA units, sometimes less than about 5 CORESTA units, often less than about 3 CORESTA units, and frequently less than about 1 CORESTA unit. Similarly, a sufficient amount of an aqueous solution of a polymeric film forming agent can be applied to a paper wrapper having a relatively low air permeability (e.g., less than about 10 CORESTA units) to provide a paper having yet a lower inherent air permeability (e.g., less than about 5 CORESTA units, and frequently less than about 1 CORESTA unit). Examples of polymeric film forming agents are sodium carboxymethylcellulose and low viscosity ammonium alginate. One wrapping material is available as P-2540-83 from Kimberly-Clark Corp.; which is a paper having a basis weight of about 32 g/m$^2$ and an initial permeability of about 6 CORESTA units to which 3.4 weight percent sodium carboxymethylcellulose has been applied to provide a final inherent permeability of about 0.7 CORESTA unit. Another wrapping material is available as P-2540-84 from Kimberly-Clark Corp.; which is a paper having a basis weight of about 31 g/m$^2$ and an initial permeability of about 17 CORESTA units to which 3.5 weight percent sodium carboxymethylcellulose is applied to provide a final inherent permeability of about 5.1 CORESTA units. Another wrapping material is available as P-2540-82 from Kimberly-Clark Corp.; which is a paper having a basis weight of about 32 g/m$^2$ and an initial permeability of about 6 CORESTA units to which 1 weight percent sodium carboxymethylcellulose is applied to provide a final inherent permeability of about 4 CORESTA units. Another wrapping material is available as P-2540-80 from Kimberly-Clark Corp.; which is a paper having a basis weight of about 32 g/m$^2$ and an initial porosity of about 6 CORESTA units to which 1.6 weight percent sodium carboxymethylcellulose is applied to provide a final inherent permeability of about 2.7 CORESTA units. Another wrapping material is available as P-2540-81 from Kimberly-Clark Corp.; which is a paper having a basis weight of about 32 g/m$^2$ and an initial permeability of about 6 CORESTA units to which 2.6 weight percent sodium carboxymethylcellulose is applied to provide a final inherent permeability of about 1.7 CORESTA units. Other wrapping materials having basis weights of about 30 g/m$^2$, air permeabilities of less than about 2 CORESTA units, having about 1 weight percent low viscosity ammonium alginate or sodium carboxymethyl- cellulose applied, and having about 4 to about 7 weight percent potassium citrate applied, are available as P-2831-60-1, P-2831-102, P-2831-140, P-2831-179, P-3122-23, P-3194-145 and P-3122-40 from Kimberly-Clark Corp. Another wrapping material is available as P-3122-4-1 from Kimberly-Clark Corp.; which is a paper having a basis weight of about 32 g/m$^2$ and an initial porosity of about 6 CORESTA units to which 1.1 weight percent sodium carboxymethylcellulose is applied to provide a final inherent permeability of about 1 CORESTA unit. Other wrapping materials are available as P-3122-40EP and from Kimberly-Clark Corp.

Such wrapping materials can include a burn chemical. Typically, the amount of burn chemical does not exceed about 10 percent; but usually is greater than about 0.25 percent, based on the dry weight of the wrapping material. Examples of burn chemicals are potassium citrate, sodium citrate, potassium acetate, sodium succinate, potassium nitrate and potassium succinate. Methods of application of such salts to the wrapping material will be apparent to the skilled artisan. If desired, sizing agents and wet strength agents, such as Hercon 70 and Aquapel from Hercules, Inc., can be incorporated into the paper wrapping materials. If desired, the various burn additives and polymeric agents can be applied to the wrapping material in separate applications or in one application as a mixture. The wrapping material can be absent of Verge lines or that wrapping material can have Verge lines. Preferably, such paper wrapping materials are perforated (e.g., electrostatically perforated) to provide the desired net permeability. For example, the wrapping material can be perforated (e.g., electrostatically perforated) so as to exhibit a net porosity of from about 30 to about 225 CORESTA units, preferably from abut 50 to abut 180 CORESTA units.

If desired, flavoring agents and/or flavor and aroma precursors (e.g., vanillin glucoside and/or ethyl vanillin glucoside) can be incorporated into the second paper wrapping material. See, U.S. Pat. No. 4,941,486 to Dube, et al., which is incorporated herein by reference.

The first or inner wrapping material most preferably comprises tobacco material. A certain amount of inorganic filler material (e.g., calcium carbonate) and/or a water soluble salt (e.g., potassium citrate) most preferably is incorporated into the inner wrapping material. The inner wrapping material also can include a carbonaceous material. The inherent permeability of the inner wrapping material can vary, but usually is higher than the inherent permeability of the outer wrapping material, and frequently is quite high relative to the outer wrapping material. Normally, the ultimate inherent permeability provided by the combined wrapping materials is slightly less than that inherent permeability of the outer wrapping material; however, effects of the inner wrapping material towards lowering the ultimate inherent permeability of the combined wrapping materials are less in instances in which the differences between the inherent permeabilities of the inner and outer wrapping materials are relatively great. Generally, the inherent permeability of the inner wrapping material is above about 10 CORESTA units, often above about 50 CORESTA units, and frequently is above about 100 CORESTA units, although the permeability of that wrapping material can approach 1,000 CORESTA units. The inner wrapping material can be perforated (e.g., electrostatically perforated) to provide the desired net permeability.

Various inner wrapping materials can be employed. One wrapping material is available as P-2540-94-A from Kimberly-Clark Corp.; which is a paper containing about 29 weight percent particles of activated charcoal provided from coconut hulls and about 71 weight percent tobacco parts, and having a permeability of about 250 CORESTA units. Another wrapping material is available as P-2540-94-C from Kimberly-Clark Corp.; which is a paper containing about 40 weight percent particles of activated charcoal provided from coconut hulls and about 60 weight percent tobacco parts, and having a permeability of about 350 CORESTA units. Another wrapping material is available as P-2540-94-D from Kimberly-Clark Corp.; which is a paper containing about 50 weight percent particles of activated charcoal provided from coconut hulls and about 50 weight percent tobacco parts, and having a permeability of about 380 CORESTA units. Another wrapping material is available as P-2540-136-C from Kimberly-Clark Corp.; which is a paper made from wood pulp, flue-cured and Burley tobacco stems and carbonized hardwood particles, and has a basis weight of about 47 g/m$^2$ and an inherent permeability of about 14 CORESTA units. Another wrapping material is available as P-3122-4-4 from Kimberly-Clark Corp.; which is a paper made from about 20 weight percent wood pulp, about 30 weight percent Turkish tobacco strip, about 30 weight percent "American blend" in cut filler form and about 20 weight percent calcium carbonate particles, and is electrostatically perforated to a net permeability of about 150 CORESTA units. Another wrapping material is available as P-2831-189-AA4 from Kimberly-Clark Corp.; which is a paper made from 20 weight percent wood pulp, about 30 weight percent Turkish tobacco strip, about 30 weight percent "American blend" in cut filler form and about 20 weight percent calcium carbonate particles, and has a basis weight of about 60 g/m$^2$ and an inherent permeability of about 125 CORESTA units. Another wrapping is available as P-3284-11 from Kimberly-Clark Corp., which is a paper made from 25 weight percent wood pulp, about 66 weight percent Turkish tobacco strip and about 9 weight percent calcium carbonate particles, and has a basis weight of about 60 g/m$^2$ and an inherent permeability of about 50 CORESTA units. Other wrapping materials include carbonaceous material, wood pulp and tobacco stem parts; have porosities between about 60 and about 150 CORESTA units; have basis weights between about 45 g/m$^2$ and about 70 g/m$^2$; and are available as P-2540-107-A, P-2540-107-B, P-2540-107-C and P-2540-107-D from Kimberly-Clark Corp. Other materials are available as P-2249-115, P-2674-157, P-2540-155, P-2540-136-D, P-2540-136-E, P-2540-152, P-2540-150, P-2540-157, P-2540-151, P-2540-156, P-2831-197-A10, P-2540-94-A, P-144-KC-G, P-144-RB, P-144-KCL, P-144-SN20, P-144-BHC, P-2674-157-A5116, P-2674-157-A5116, P-2831-130, P-2831-22-1, P-2831-23-3, P-1976-25-1, P-1976-25-2, P-2540-191, P-2540-192, P-2540-193, P-2540-194, P-2540-195, P-2540-196, P-1976-25-3, P-2831-189-B1-6606, P-2831-189-B2-6608 and P-2831-189-B3-6609 from Kimberly-Clark Corp. Although less preferred from a manufacturing standpoint, the inner wrap also can be a reconstituted tobacco material of the type described in U.S. Pat. Nos. 4,962,774 to Thomasson, et al. and 4,987,906 to Young, et al. and U.S. patent application Ser. No. 710,273, filed Jun. 4, 1991.

The most preferred inner wrapping materials are tobacco containing papers. Tobacco containing papers are made from tobacco parts (e.g., tobacco stems, tobacco fines, pieces of tobacco stems, tobacco dust, tobacco cut filler, tobacco strip, tobacco leaf, processed tobacco stems, tobacco scrap, extracted tobacco pulp, and/or tobacco extracts). Preferred tobacco containing papers include the cellulosic portion of the tobacco material, and also can include one or more tobacco extracts. As such, preferred tobacco containing papers incorporate tobacco as a cellulosic component. The inner wrapping materials also can have cellulosic materials (e.g., wood pulp), as well as additive water soluble salts and additive inorganic fillers (e.g., calcium carbonate and/or magnesium hydroxide) incorporated therein. Methods for manufacturing such papers will be apparent to the skilled artisan.

Certain preferred tobacco containing inner wrapping materials include more than about 25 weight percent, usually more than about 50 weight percent, and preferably about 50 to about 85 weight percent tobacco. Certain preferred wrapping materials also can include up to about 50 weight percent, and preferably about 20 to about 70 weight percent cellulosic material. Examples of useful cellulosic materials include softwood pulp, hardwood pulp and flax fibers. Such wrapping materials also can include up to about 35 weight percent, preferably up to about 25 weight percent, and more preferably up to about 20 weight percent inorganic filler additive. Examples of inorganic filler materials include calcium carbonate particles, calcium sulfate fibers, particles of calcium sulfate, magnesium oxide, magnesium hydroxide, and agglomerated filler materials described in European Patent Application No. 419,733. Certain preferred inner wrapping materials include greater than about 5 weight percent magnesium oxide and/or magnesium hydroxide filler. Such wrapping materials also can include up to about 10 weight percent, preferably up to about 6 weight percent, and most preferably about 1 to about 3 weight percent of at least one additive salt, such as a water soluble salt. Such an additive salt can act as a burn chemical. Examples of such additive salts include inorganic salts (e.g., potassium chloride and potassium nitrate) and salts having inorganic cations (e.g., potassium citrate, potassium acetate, potassium propionate and potassium succinate). Such wrapping materials can be perforated (e.g., electrostatically perforated), if desired, to provide wrapping materials having net porosities greater than the inherent porosities thereof.

Certain preferred inner wrapping materials include about 65 to about 85 weight parts tobacco, and about 15 to about 35 weight parts softwood pulp. Such tobacco containing papers can have high or low air permeability, high or low levels of additive salt burn chemical (e.g., potassium succinate or potassium citrate), high or low levels of inorganic filler material, and can be perforated (e.g., electrostatically perforated), if desired.

The inner wrapping material normally includes a burn chemical (e.g., at least one water soluble salt additive). Typically, the amount of burn chemical does not exceed about 10 percent; but usually is greater than about 0.25 percent, based on the dry weight of the wrapping material. Certain wrapping materials can have very low levels, or be absent, of added burn chemical, particularly if that material includes a relatively high level of an aqueous tobacco extract therein. In particular, wrapping materials having an aqueous tobacco extract content of greater than about 25 percent, usually greater than about 30 percent, based on the dry weight of the wrapping material, can be employed in the absence of any added burn chemical.

The optional carbonaceous material of the inner wrap can vary. The carbonaceous material is combustible under those conditions (i.e., temperatures) experienced during the period that the cigarette is smoked. The carbonaceous material most preferably is derived from natural cellulosic materials. Certain natural cellulosic materials have a high cellulose content (i.e., a cellulose content above about 80 weight percent), and often a high alpha-cellulose content (i.e., an alpha-cellulose content above about 80 weight percent). Examples of natural cellulosic materials which can be pyrolyzed to provide combustible carbonaceous materials include tobacco materials, softwood pulp, hardwood pulp, coconut hulls, kapok fibers, cotton fibers, cotton linters, and the like, as well as combinations thereof. Combustible carbonaceous materials typically are provided by pyrolyzing a natural cellulosic material under inert (e.g., nitrogen) atmosphere at temperatures between about 600° C. and about 1,200° C., preferably between about 650° C. and about 850° C. Preferred carbonaceous materials include at least about 80 weight percent carbon, normally include about 85 weight percent and about 95 weight percent carbon. Exemplary carbonaceous materials are set forth in European Patent Application Nos. 236,992 and 419,733; and U.S. patent application Ser. No. 378,551, filed Jul. 11, 1980 now U.S. Pat. No. 4,991,596, which are incorporated herein by reference.

The amount of the optional carbonaceous material within the inner wrapping material can vary. Typical inner paper wrapping materials have relatively high levels of carbonaceous material and/or incorporate carbonaceous materials formed under relatively high pyrolysis temperatures when outer wrapping materials are of relatively low porosity. Normally, the amount of the optional carbonaceous material within the inner wrapping material is greater than about 5 percent, usually greater than about 10 percent, generally greater than about 20 percent, often greater than about 30 percent, and frequently greater than about 40 percent, based on the weight thereof. The form of the carbonaceous material can vary; but is typically in powder or particulate form of about 5 microns to about 20 microns in diameter.

The amount of the optional carbonaceous material within the inner wrapping material relative to the total weight of the tobacco rod can vary. Often, the inner wrap comprises greater than about 2, often about 2 to about 8, and frequently about 3 to about 7 percent carbonaceous material therewithin, based on the total weight of the tobacco rod. Typically, when the outer wrapping material has a porosity which is extremely low (i.e., about 2 CORESTA units or less), the inner wrapping material often can have a relatively high level of the optional carbonaceous material therewithin (i.e., about 5 percent or more, based on the weight of the tobacco rod).

Certain flavoring agents can be incorporated into or otherwise carried by the inner wrapping material. In particular, the optional carbonaceous material of the inner wrapping material can act as a particularly good substrate for certain flavoring agents. Examples of suitable flavoring agents include menthol, vanillin, and the like. Suitable flavoring agents are set forth in Leffingwell, et al., *Tobacco Flavoring For Smoking Products* (1972). The carbonaceous material is a particularly good substrate for volatile flavoring agents. If desired, flavor and aroma precursors can be incorporated into the inner wrapping material.

Exemplary tobacco rods having two layers of wrapping material circumscribing a charge of tobacco cut filler are described in Examples 1 through 32 of U.S. patent application Ser. No. 661,747, filed Feb. 27, 1991, which is incorporated herein by reference.

Typically, the filter element has a length which ranges from about 15 mm to about 40 mm, preferably about 20 mm to about 35; and a circumference of about 17 mm to about 27 mm, preferably about 22 mm to about 25 mm. The filter element can have a wide range of filtration efficiencies. Typically, the filter segment containing carbonaceous material has a low filtration efficiency for particulate matter.

For filter elements having 2 filter segments (e.g., as described with reference to FIG. 1), the rod end filter segment typically has a length of about 20 to about 60 percent of the total length of filter element, while the mouthend filter segment typically has a length of about 40 to about 80 percent of the total length of the filter element. For filter elements having 3 filter segments (e.g., as described with reference to FIG. 3), the rod end filter segment typically has a length of about 15 to about 30 percent of the total length of the filter element, the mouthend filter segment typically has a length of about 15 to about 30 percent of the total length of the filter element, and the center filter segment typically has a length of about 30 to about 60 percent of the total length of the filter element.

The carbonaceous material which is incorporated into the filter element can vary. Most preferred carbonaceous materials are highly activated. Carbonaceous materials most useful herein have a high carbon content; consist primarily of carbon; and preferably have a carbon content above about 80 weight percent, and more preferably above about 90 weight percent. Preferred carbonaceous materials are provided by carbonizing or pyrolyzing tobacco material, softwood pulp, hardwood pulp, coconut hulls, kapok fibers, cotton fibers, cotton linters, and the like. Examples of suitable carbonaceous materials are activated coconut hull based carbons available from Calgon Corp. as PCB 12x30 and GRC-11 12x30. Examples of suitable carbonaceous materials are coal based carbons available from Calgon Corp. as S-Sorb 12% Cu 12x30; BPL 12x30; CRC-11F 12x30; FCA 12x30, Cu, $CrO_3$; and SGL. Examples of suitable carbonaceous materials are wood based carbons available from Westvaco as WV-B, SA-20 and BSA-20. Other carbonaceous materials are available from Calgon Corp. as HMC; ASC/GR-1 12x30 Cu, Ag, $CrO_3$; and SC II; and another carbonaceous material includes Witco Carbon No. 637. Other carbonaceous materials are described in U.S. patent application Ser. No. 569,325, filed Aug. 17, 1990; U.S. Pat. Nos. 4,771,795 to White, et al. and 5,027,837 to Clearman, et al; and European Patent Application Nos. 236,922; 419,733 and 419,981. Certain carbonaceous materials can be impregnated with substances such as propylene glycol, potassium bicarbonate, tobacco extracts, polyethyleneimine, manganese dioxide, eugenol, and 4-ketononanoic acid. The size of the individual carbon particles or granules can vary, depending upon the design of the filter element. Typically, large size particles have a U.S. mesh size of about −6/+16; medium size particles have a U.S. mesh size of about −12/+30; and small size particles have U.S. mesh sizes of about −20/+50 and −30/+70. Carbonaceous materials also can have a monolithic form, a bonded granular form, a fibrous form, or an agglomerated form; or be combined with molecular sieves, alumina particles or ion exchange resin particles.

The carbon for the filter segment of the filter element can be provided within a paper, and that paper can be shredded, gathered, or corrugated and gathered to form the filter segment. Typically, for a filter element having a circumference of about 22 mm to about 25 mm, the carbon-containing paper which is gathered to form a filter segment has a width of about 3.5 inches to about 11 inches, and usually about 5 inches to about 8.5 inches. Shredded paper filter segments can be provided as described in U.S. Pat. No. 5,025,814 to Raker. Gathered paper filter segments can be provided (i) using the apparatus described in U.S. Pat. No. 4,807,809 to Pryor, et al.; (ii) using the apparatus generally as described by Keith, et al. in U.S. Pat. No. 4,283,186 at col. 4, line 50 through col. 5, line 6; or (iii) using a rod making unit available as CU-10 or CU20S from Decoufle s.a.r.b., together with a KDF-2 rod making apparatus from Hauni-Werke Korber & Co., K. G. Filter segments can be provided by simultaneously gathering a tobacco-containing paper web and a carbon-containing paper web, so as to provide a segment having two types of gathered papers. Filter segments also can be provided by simultaneously gathering a carbon-containing paper web and a web of thermoplastic material (e.g., as described in U.S. patent application Ser. Nos. 414,833, filed Sep. 29, 1989 now U.S. Pat. No. 5,074,321; 606,287, filed Nov. 6, 1990; and 621,499, filed Dec. 7, 1990 now U.S. Pat. No. 5,105,834), so as to provide a segment having two types of gathered Carbon-containing filter segments then can be plug tube combined with one or more other filter segments (e.g., with a segment of gathered polypropylene web, gathered cellulose acetate web, or cellulose acetate tow) using known plug tube combination techniques.

Exemplary carbon-containing papers are available as P-144-BSHC, P-144-BAC and P-144-BHC from Kimberly-Clark Corp. Other carbon-containing papers are described in European Patent Application No. 342,538, which is incorporated herein by reference. Other carbon-containing papers are available from Kimberly-Clark Corp. as P-2674-12-12, P-2674-13-17, P-2674-14-24, P-2674-11-3, P-2674-11-7, P-3122-6-8, P-3122 -6-8, P-3122-6-6, P-3122-6-5, P-3122-6-12 and P-3001-72-1. Other carbon-containing papers will be apparent to the skilled artisan. For example, carbon particles can be embedded in a paper substrate and employed as a filter material for a filter segment.

Carbon particles or granules can be dispersed within filter material, such as cellulose acetate tow. The amount of carbonaceous material dispersed within a particular filter material of a filter element can vary. However, each filter element typically includes about 10 mg to about 130 mg, usually about 25 mg to about 100 mg, and frequently about 40 mg to about 75 mg of carbonaceous material. One preferred filter element includes a segment containing about 50 mg of carbonaceous powder having an average particle size of about 40 microns in diameter.

Other filter designs can be employed. For example, the carbonaceous materials can be employed in the form of loose granules. A so-called "cavity filter" of 27 mm length has a 12 mm segment of cellulose acetate tow (8 denier per filament/40,000 total denier), a 12 mm segment of gathered carbon-containing paper available as P-144-BAC from Kimberly-Clark Corp. and a 3 mm cavity between the two segments containing 60 mg of PCB carbon from Calgon Corp. of +12/−30 mesh size. Another filter element includes carbon threads and is available as ACT from FIL International, Ltd. Another filter element has a carbon-containing segment provided by inserting about 60 mg of −12/+30 carbon particles into the longitudinal passageway of a highly plasticized cellulose acetate tube. Other filter elements can include segments containing carbonaceous materials and segments such as those described in U.S. patent application Nos. 414,833 filed Sep. 29, 1989 now U.S. Pat. No. 5,074,321; 606,287 filed Nov. 6, 1990 now U.S. Pat. No. 5,105,834; and 621,499, filed Dec. 7, 1990.

The so-called "dual segment charcoal filter elements" can be employed. One 27 mm filter element includes a 7 mm black-dyed cellulose acetate tow segment impregnated with about 32.5 mg activated carbon particles of −30/+70 mesh size, and a 20 mm plasticized cellulose acetate tow segment, which filter element is available as SCS IV Dual Solid Charcoal Filter from American Filtrona Corp. One 31 mm filter element includes an 11 mm black-dyed cellulose acetate tow segment impregnated with about 32.5 mg of charcoal carbon particles of −30/+70 mesh size, and a 20 mm plasticized cellulose acetate tow segment, which filter element is available as SCS IV Dual Solid Charcoal Filter from American Filtrona Corp. One 31 mm filter element includes an 18 mm cellulose acetate (5.0 denier per filament/35,000 total denier) segment impregnated with 46 mg of activated carbon of −30/+70 mesh size and a 13 mm segment of plasticized cellulose acetate tow (3.0 denier per filament/35,000 total denier), which is available as Dual Solid Charcoal Filter from Baumgartner. One 21 mm filter element includes a 10 mm cellulose acetate tow (3.3 denier/per filament/37,000 total denier) segment impregnated with about 46 mg activated carbon particles, and an 11 mm segment of cellulose acetate tow (2.5 denier per filament/37,000 total denier), which is available as Dual Segment Charcoal Filter from FIL International, Ltd.

The so-called "triple filter charcoal filter elements" can be employed. One 21 mm filter element includes 2 segments of cellulose acetate tow (2.5 denier per filament/37,000 total denier) of 5.5 mm length, and a center segment of 10 mm length comprising cellulose acetate tow (3.3 denier per filament/37,000 total denier) impregnated with 46 mg of activated carbon particles, which is available as Triple Solid Charcoal Filter from FIL International, Ltd. One 21 mm filter element includes an 11 mm segment of cellulose acetate tow, a 6 mm segment of cellulose acetate tow, and a cavity of 4 mm length between the two segments filled with 63 mg of charcoal particles, which is available as Triple Cavity Filter from Baumgartner. One 21 mm filter element includes a 10 mm segment of cellulose acetate tow, a 6 mm segment of cellulose acetate tow, and a cavity of 5 mm length between the two segments filled with 58 mg of charcoal particles, which is available as Triple Cavity Filter from FIL International, Ltd.

Typically, the tipping material circumscribes the filter element and an adjacent region of the tobacco rod such that the tipping material extends about 3 mm to about 6 mm along the length of the tobacco rod. Typically, the tipping material is a conventional paper tipping material and is adhesively secured to the filter element and the adjacent region of the tobacco rod. The tipping material can have a permeability which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

For air diluted or ventilated cigarettes of this invention, the amount of air dilution can vary. Often, the amount of air dilution for an air diluted cigarette is greater than about 10 percent, and frequently greater than about 25 percent. The upper limit of air dilution for a cigarette typically is less than about 75 percent, more frequently less than about 65 percent.

Cigarettes of the present invention exhibit a desirably high resistance to draw. For example, cigarettes of this invention exhibit a pressure drop of between about 50 and about 200 mm water pressure drop at 17.5 cc/sec. air flow. Typically, pressure drop values of cigarettes are measured using a Filtrona Filter Test Station (CTS Series) available from Filtrona Instruments and Automation Ltd. Cigarettes of this invention preferably exhibit resistance to draw values of about 70 to about 180, more preferably about 80 to about 150 water pressure drop at 17.5 cc/sec. air flow.

Cigarettes of the present invention, when smoked, generally yield less than about 20 mg, preferably less than about 10 mg of sidestream "tar" per cigarette, as determined using the apparatus and techniques described by Proctor, et al., *Analyst,* Vol. 113, p. 1509 (1988). Such cigarettes normally provide more than about 6 puffs, preferably more than about 8 puffs per cigarette when smoked under FTC conditions. FTC conditions consist of 35 ml puffs of 2 second duration separated by 58 seconds of smolder. Normally, cigarettes of the present invention provide less than about 15 puffs, and often less than about 12 puffs, when smoked under FTC conditions. Normally, cigarettes of the present invention yield less than about 2 mg, preferably less than about 1.5 mg, and most preferably less than about 1 mg of sidestream "tar" per 1 minute puff cycle period, when smoked under FTC conditions.

Cigarettes of the present invention, when smoked, yield ash and firecone which are acceptable. The ash is not overly dark in color, is not easily dislodged from the cigarette, and is not flaky. The firecone is of acceptable length, is not overly cohesive, and is not overly fragile (i.e., maintains its integrity).

Cigarettes of the present invention exhibit a tendency to maintain smolder under static burning conditions (i.e., without puffing after the lighting puff). Much preferred cigarettes maintain smolder for at least about 3 minutes, more preferably at least about 5 minutes, and often at least about 7 minutes, without self-extinguishing. Preferred cigarettes are such that at least about one third of the burnable length of the tobacco rod, often at least about one half of the burnable length of the tobacco rod, and frequently the total burnable length of the tobacco rod is consumed during static burning conditions without self-extinguishing.

Cigarettes of the present invention burn at an acceptable rate during smoking, particularly under free smolder (i.e., static burning) conditions. Typical cigarettes of the present invention, and particularly those cigarettes having a circumference of about 24 mm to about 25 mm, exhibit a static tobacco rod linear burn rate of less than about 5 mm/min., and frequently between about 1.5 mm/min. and about 4 mm/min.

Cigarettes of the present invention generally provide FTC "tar" yields in the range from about 2 to about 14 mg/cigarette, although other "tar" yields are possible. Typical FTC "tar" to FTC carbon monoxide ratios for such cigarettes are less than about 1.8, and sometimes are less than about 1.6. Cigarettes of the present invention exhibit desirable organoleptic properties. Cigarettes having carbonaceous materials within the filter element preferably exhibit a smooth smoking character, and provide less harsh and less bitter attributes than comparable cigarettes not having such a filter element. Preferred filter elements assist in reducing the gas phase components of cigarette smoke that provide a harsh and bitter character to the flavor of such smoke.

The following examples are provided in order to further illustrate the invention but should not be construed as limiting the scope thereof. Unless otherwise noted, all parts and percentages are by weight.

EXAMPLE 1

Cigarettes substantially as shown in FIG. 1 are prepared as follows:

The cigarettes each have a length of about 84 mm and a circumference of about 24.8 mm, and include a tobacco rod having a length of 57 mm and a filter element having a length of about 27 mm. Each filter element includes a filter segment of gathered carbon paper and a filter segment of cellulose acetate tow. The first filter segment has a length of about 12 mm, and includes a gathered carbon paper available as P-144-BHC from Kimberly-Clark Corp. circumscribed by Reference No. 646 nonporous paper plug wrap from Kimberly-Clark Corp. The carbon paper is a carbon/tobacco paper containing about 17 percent PCB carbon of about 40 micron diameter. The first filter segment is provided by gathering an 8.5 inch width web of carbon paper as described in Example 1 of U.S. Pat. No. 4,807,809 to Pryor, et al. The second filter segment has a length of about 15 mm, and includes triacetin plasticized cellulose acetate tow. The cellulose acetate tow circumscribed by nonporous paper plug wrap. The tow item is 2.1 denier per filament/48,000 total denier. Each first and second filter segment are attached together in an end-to-end relationship using a circumscribing nonporous plug wrap to provide a filter element. Each filter element is attached to each tobacco rod using nonporous tipping paper. For each cigarette, the tipping paper circumscribes the filter element and about a 4 mm length of the tobacco rod in the region adjacent the filter element. The filter elements are ventilated to about 55 percent air dilution by providing a ring of mechanical perforation around the paper wrapping materials of the filter element about 13 mm from the extreme mouthend of the cigarette.

The smokable blend consists of tobacco material which has been cased with a casing mixture. The tobacco material has flue-cured, Burley and Oriental tobaccos as well as reconstituted tobacco from a papermaking process, and volume expanded flue-cured and Burley tobaccos. The blend of tobacco materials is cased using a mixture of glycerin, water and flavors. The blend is in the form of strands or shreds cut at about 25 cuts per inch (i.e., in cut filler form) and is equilibrated to a moisture level of about 12.5 percent. Each cigarette rod includes about 650 mg tobacco material.

The second or outer cigarette paper wrap is a 70 to 75 parts wood pulp and 25 to 30 parts calcium carbonate paper available as P-3122-40EP from Kimberly-Clark Corp. The paper wrap exhibits a net air permeability of about 55 CORESTA units provided by electrostatic perforation, and a basis weight of about 35.5 g/m$^2$. The paper wrap includes about 1.3 percent ammonium alginate, about 0.4 percent Hercon 70 from Hercules Inc. and about 4.4 percent potassium citrate applied thereto, and the paper exhibits an inherent permeability (i.e., a porosity prior to electrostatic perforation) of about 1 CORESTA unit.

The first or inner cigarette paper wrap is available as P-3284-11 from Kimberly-Clark Corp. The paper wrap includes tobacco parts, wood pulp and calcium carbonate particles. The inner paper wrap is absent of added burn chemical in the form of added water soluble salt. The paper is light brown in color, has a somewhat rough surface texture, and exhibits an inherent permeability of about 50 CORESTA units.

The tobacco rod is such that the inner wrap circumscribes the smokable blend and the outer wrap circumscribes the inner wrap. The inner and outer wraps directly contact one another (i.e., the inner surface of the outer wrap contacts the outer surface of the inner wrap).

The cigarettes are employed by burning the tobacco rod such that the blend of smokable material within the paper wrapper burns to yield smoke. When employed, such cigarettes yield very low levels of visible sidestream smoke and sustains smolder under static burning conditions after the lighting puff such that the total burnable length of the tobacco rod is consumed (i.e., the cigarette does not self-extinguish).

EXAMPLE 2

Cigarettes are provided as described in Example 1, except that the filter element is replaced with a filter element available as TSS 4035 from FIL International, Ltd. The cigarette is air diluted about 50 percent.

EXAMPLE 3

Cigarettes are provided as described in Example 1, except that the filter element is replaced with a filter element available as TSS 4036 from FIL International, Ltd. The cigarette is air diluted about 50 percent.

EXAMPLE 4

Cigarettes are provided as described in Example 1, except that the filter element is replaced with a filter element available as TSS 4054 from FIL International, Ltd. The cigarette is air diluted about 50 percent.

EXAMPLE 5

Cigarettes are provided as described in Example 1. However, the outer paper wrap of the tobacco rod is available as TOD 05504 from Ecusta Corp.; the inner wrap of the tobacco rod is available as P-2540-195 from Kimberly-Clark Corp., and the cigarette is air diluted to an air dilution level of about 50 percent.

The outer paper wrap is a heavy weight sheet, low visible sidestream paper. The base sheet contains about 15 percent calcium carbonate, about 25 percent magnesium hydroxide and about 60 percent flax fiber. The paper has an inherent permeability of about 10 CORESTA units and a basis weight of about 48 g/m$^2$. The paper has an aqueous solution including 2 percent malic acid and 12 percent potassium chloride incorporated therein using a size press. The paper includes about 45 mg potassium ions per gram of dry base sheet and about 1.3 percent malate ion analyzed in the paper (i.e., added to the paper as malic acid). The level of potassium ions in the paper is significantly greater than the level of sodium ions in the paper. The paper is electrostatically perforated so as to yield a net porosity of about 110 CORESTA units.

EXAMPLE 6

Cigarettes are provided as described in Example 5. However, the inner wrap of the tobacco rod is available as P-2540-194 from Kimberly-Clark Corp.; the first filter segment is provided by gathering a carbon paper web 8.5 inches wide and available as P-144-BSHC from Kimberly-Clark Corp., and the second filter segment includes plasticized cellulose acetate tow (2.7 denier per filament/48,000 total denier). The cigarette is air diluted about 50 percent.

EXAMPLE 7

Cigarettes are provided as described in Example 4. However, the first filter segment is provided by gathering a carbon paper web 8.5 inches wide available as P-144-50AC from Kimberly-Clark Corp.

EXAMPLE 8

Cigarettes substantially as described in Example 1 are provided, except that the second or outer paper wrap is available as TOD 05759 from Ecusta Corp., and the first or inner wrap is available as P-2831-189-AA4 from Kimberly-Clark Corp. The inner wrap is not electrostatically perforated, and is absent of added burn chemical in the form of added water soluble salt.

The second or outer paper wrap is a heavy weight sheet, low visible sidestream paper. The base sheet contains about 30 percent calcium carbonate, about 8 percent magnesium hydroxide and about 62 percent flax fiber. The paper has an inherent permeability of about 10 CORESTA units and a basis weight of about 48 $g/m^2$. The paper has an aqueous solution including 2 percent malic acid, 6 percent potassium malate, 6 percent potassium chloride and 2.5 percent of an additive package available as DY 05012 from Quest International incorporated therein using a size press. The paper includes about 39 mg potassium ions per gram of dry base sheet and about 3.8 percent malate ion analyzed in the paper (i.e., added to the paper as potassium malate and malic acid). The paper is electrostatically perforated so as to yield a net porosity of about 110 CORESTA units.

EXAMPLE 9

Cigarettes substantially as shown in FIG. 1 are prepared as follows:

The cigarettes each have a length of about 84 mm and a circumference of about 24.8 mm, and include a tobacco rod having a length of about 63 mm and a filter element having a length of about 21 mm. Each filter element includes about 46 mg carbon particles and is available as Dual Solid Charcoal Filter from FIL International, Ltd. The length of the first filter segment is about 10 mm, and the length of the second filter segment is about 11 mm.

The outer wrap of the tobacco rod is available as TOD 05992 from Ecusta Corp., and the inner wrap of the tobacco rod is available as P-3284-11 from Kimberly-Clark Corp.

The smokable material is an "American blend" of the type described in Example 1. Each cigarette rod includes about 720 mg tobacco material.

The cigarette is air diluted about 50 percent by providing a ring of perforations 13 mm from the extreme mouthend of the cigarette.

EXAMPLE 10

Cigarettes are provided as described in Example 9. However, the outer paper wrap of the tobacco rod is a paper available as TOD 05504 from Ecusta Corp. and the inner paper wrap of the tobacco rod is available as P-2540-195 from Kimberly-Clark Corp. The cigarette is air diluted about 50 percent.

EXAMPLE 11

Cigarettes substantially as shown in FIG. 3 are provided as described in Example 9. However, the filter element is available as Triple Solid Filter from FIL International, Ltd. The cigarette is air diluted about 50 percent by providing a ring of perforations 13 mm from the extreme mouthend of the cigarette.

EXAMPLE 12

Cigarettes substantially as shown in FIG. 3 are provided as described in Example 9. However, the outer wrap of the tobacco rod is available as TOD 05504 from Ecusta Corp., the inner paper wrap of the tobacco rod is available as P-2540-195 from Kimberly-Clark Corp., and the filter element is available as Triple Solid filter from FIL International, Ltd. The cigarette is air diluted about 50 percent by providing a ring of perforations 13 mm from the extreme mouthend of the cigarette.

EXAMPLE 13

Cigarettes substantially as shown in FIG. 3 are prepared as follows:

The cigarettes each have a length of about 99 mm and a circumference of about 24.75 mm, and include a tobacco rod having a length of abut 68 mm and a filter element having a length of about 31 mm. Each filter element includes about 50 mg highly activated coconut hull carbon particles dispersed in an 11 mm long segment of cellulose acetate tow. The filter element is available as TSS 4037 from FIL International, Ltd.

The outer wrap of the tobacco rod is available as TOD 05992 from Ecusta Corp. The inner wrap of the tobacco rod is available as P-3284-11 from Kimberly-Clark Corp.

The smokable material is an "American blend" of the type described in Example 1. Each cigarette rod includes about 910 mg tobacco material.

The cigarette is air diluted about 50 percent by providing a ring of perforations about 17 mm from the extreme mouthend of the cigarette.

EXAMPLE 14

Cigarettes are provided as described in Example 13. However, the outer wrap of the tobacco rod is available as P-3122-40EP from Kimberly-Clark Corp. The cigarette is air diluted about 55 percent by providing a ring of perforations about 17 mm from the extreme mouthend of the cigarette.

EXAMPLE 15

Cigarettes substantially as shown in FIG. 3 are prepared as follows:

The cigarettes each have a length of about 84 mm and a circumference of about 24.7 mm. The tobacco rod has a length of about 57 mm, and the filter element has a length of about 27 mm. Each filter element includes a first 15 mm segment of gathered carbon paper and a second 12 mm segment of cellulose acetate tow. The first segment is a 8.5 inch wide carbon/tobacco paper available as P-144-BAC from Kimberly-Clark Corp., gathered using the apparatus described in Example 1 of U.S. Pat. No. 4,807,809 to Pryor, et al. and circumscribed by paper plug wrap. The second segment is triacetin plasticized cellulose acetate tow (8.0 denier per filament/40,000 total denier) circumscribed by paper plug wrap. The two segments are plug tube combined into a filter element using circumscribing paper plug wrap.

The smokable material is a blend of 17 parts flue-cured tobacco cut filler and 83 parts of another smokable filler material. The other smokable material is a cut filler material obtained by casting and drying an aqueous slurry including 5 percent sodium carboxymethylcellulose, 6 percent glycerin, and 89 percent of an agglomerated material of carbonaceous material and calcium carbonate of the type described in European Patent Application No. 419,733.

The smokable material is circumscribed by a tobacco-containing paper available as P-2249-115 from Kimberly-Clark Corp. The tobacco-containing paper is circumscribed by a paper of the type described at col. 19, lines 16–23 of European Patent Application No. 419,733.

The filter element is attached to the tobacco rod using non-porous tipping paper. The cigarette is not air diluted.

EXAMPLE 16

Cigarettes are provided as described in Example 15. However, the tobacco-containing paper inner wrap of the tobacco rod is a tobacco-containing paper available as P-2674-157 from Kimberly-Clark Corp.; and the carbon/tobacco paper of the filter element is a gathered paper containing activated coconut hull carbon and available as P-144-17AC from Kimberly-Clark Corp.

EXAMPLE 17

Cigarettes are provided as described in Example 15. However, the inner wrap of the tobacco rod is available as P-2674-157 from Kimberly-Clark Corp.; and the carbon/tobacco paper of the filter element is a gathered paper available as P-144-21AC from Kimberly-Clark Corp.

EXAMPLE 18

Cigarettes are provided as described in Example 15.However, the inner wrap of the tobacco rod is available as P-2674-157 from Kimberly-Clark Corp.; and the carbon/tobacco paper of the filter element is a gathered paper available as P-144-33AC from Kimberly-Clark Corp.

EXAMPLE 19

Cigarettes are provided as described in Example 15. However, the inner wrap of the tobacco rod is available as P-2674-157 from Kimberly-Clark Corp.; and the paper of the filter element is a gathered soft wood pulp/carbon paper having a thickness of about 0.005 inch available as P-144-50AC from Kimberly-Clark Corp.

EXAMPLE 20

Cigarettes substantially as shown in FIG. 3 are prepared as follows:

Cigarettes have rod lengths, filter element lengths and circumferences essentially equal to those of the cigarettes described in Example 15. The smokable blend also is described in Example 15. The inner wrap of the tobacco rod is a tobacco-containing paper available as P-2674-157 from Kimberly-Clark Corp. The outer wrap of the tobacco rod is available as DD-100-2 from Kimberly-Clark Corp.

The filter element includes 3 segments. The segment adjacent the tobacco rod is 7 mm long, and includes a gathered web of about 11 inch width of non-woven polyproylene fibers, which web is available as PP-100-F from Kimberly-Clark Corp. circumscribed by paper plug wrap. The center segment is 8 mm long and includes a plasticized cellulose acetate tube available from American Filtrona Corp. with 60 mg of Calgon PCB carbon particles of $-12/+30$ U.S. mesh size positioned in the longitudinally extending passageway of about 3.2 mm diameter in that tube. The mouthend segment is 12 mm long and includes plasticized cellulose acetate tow (8 denier per filament/40,000 total denier) circumscribed by paper plug wrap.

The three filter segments are attached together by a circumscribing paper plug wrap to form a filter element. The filter element is attached to the tobacco rod using non-porous tipping paper. The cigarette is not air diluted.

EXAMPLE 21

Cigarettes substantially as shown in FIG. 1 are provided using materials as described in Example 20. However, the first filter segment is a 15 mm segment of a filter available as ACT Activated Carbon Thread Filter from American Filtrona Corp., and the second filter segment is a 12 mm segment of triacetin plasticized cellulose acetate tow (8 denier per filament/40,000 total denier) circumscribed by paper plug wrap.

EXAMPLE 22

Cigarettes substantially as shown in FIG. 1 are prepared as follows:

The cigarettes each have a length of about 84 mm and a circumference of about 24.8 mm, and include a tobacco rod having a length of about 57 mm and a filter element having a length of about 27 mm. Each filter element includes a filter segment of gathered carbon paper and a filter segment of cellulose acetate tow. The first filter segment has a length of about 15 mm, and includes carbon paper available as P-144-50AC from Kimberly-Clark Corp. gathered as described in Example 1. The second filter segment has a length of about 12 mm, and includes triacetin plasticized cellulose acetate tow (2.7 denier per filament/48,000 total denier). The filter material of each filter segment is circumscribed by paper plug wrap. The two filter segments are combined by a circumscribing paper plug wrap.

The smokable material is a blend of 85 parts flue-cured tobacco cut filler and 15 parts Samsun Oriental tobacco cut filler. The smokable material has a casing formula applied thereto in order that the cut filler blend has in contact therewith 0.35 percent licorice powder, 0.92 percent glycerine, 0.45 percent propylene glycol, 0.62 percent St. John's Bread (light roast) powder, 0.23 percent absolute cocoa from Robertet, Inc., 0.92 percent Fig Supreme Flavor from Bell Flavors, In., and 1.05 percent potassium carbonate. Then, the cased blend is volume expanded using the G-13 process of R. J. Reynolds Tobacco Company to provide a cased, puffed tobacco blend.

About 320 mg of the tobacco blend is circumscribed by a tobacco containing paper available as P-2831-189-B4-6606 from Kimberly-Clark Corp. The paper includes wood pulp as well as flue-cured, Burley and Basma Oriental tobacco pieces. The tobacco containing paper is in turn circumscribed by an outer paper wrap available as Reference No. 854 from Kimberly-Clark Corp. The resulting tobacco rod weighs about 0.54 g.

The filter element is attached to one end of the tobacco rod using circumscribing non-porous tipping paper. The cigarette is air diluted 33 percent by providing a ring of perforations about 13 mm from the extreme mouthend of the cigarette.

The cigarette yields 7.3 puffs when smoked under FTC smoking conditions.

EXAMPLE 23

Cigarettes are provided as described in Example 15. However, the outer wrap of the tobacco rod is available as DD-100-2 from Kimberly-Clark Corp. The inner wrap of the tobacco rod is available as P-2674-157 from Kimberly-Clark Corp., the first filter segment is a 15 mm long segment provided by gathering an 8.5 inch wide web of carbon-containing paper available as P-144-50AC from Kimberly-Clark Corp. using a rod making apparatus, the second filter segment is a 12 mm long segment of cellulose acetate tow (2.7 denier per filament/48,000 total denier), and the smokable blend is that blend described in Example 22.

EXAMPLE 24

Cigarettes are made as described in Example 1, except that the second or outer paper wrap is available as TOD 05992 from Ecusta Corp. The second or outer wrap is a heavy weight sheet, low visible sidestream paper. The base sheet contains about 15 percent calcium carbonate, about 25 percent magnesium hydroxide and about 60 percent flax fiber. The paper has an inherent permeability of about 10 CORESTA units and a basis weight of about 48 g/m$^2$. The paper has an aqueous solution including about 2 percent malic acid, about 2 percent potassium malate, and about 10 percent potassium chloride incorporated therein using a size press. The paper includes abut 52 mg potassium ions per gram of dry base sheet. The paper is electrostatically perforated so as to yield a net porosity of about 110 CORESTA units.

EXAMPLE 25

Cigarettes are provided as described in Example 22, using the smokable blend described in Example 22. However, the outer wrap of the tobacco rod is a paper available as TOD 05375 from Ecusta Corp.

What is claimed is:

1. A cigarette comprising (A) a smokable rod including smokable material contained in first and second circumscribing outer wrapping materials; the first wrapping material circumscribing the smokable filler material, and the second wrapping material circumscribing and overwrapping the first wrapping material; the first wrapping material including a salt additive and tobacco material; and the second wrapping material (i) including a cellulosic base web and inorganic filler material, (ii) exhibiting an inherent air permeability below about 15 CORESTA units, and (iii) exhibiting a net air permeability above about 40 CORESTA units; and (B) a filter element including a carbonaceous material.

2. The cigarette of claim 1 wherein the smokable material consists essentially of tobacco filler material.

3. The cigarette of claim 2 wherein the tobacco filler material includes casing and/or top dressing components.

4. The cigarette of claim 1 wherein the second wrapping material exhibits an inherent air permeability below about 5 CORESTA units.

5. The cigarette of claim 1 wherein the inorganic filler material of the second wrapping material includes magnesium hydroxide.

6. The cigarette of claim 1, 4 or 5 wherein the second wrapping material exhibits a net air permeability between about 50 and about 225 CORESTA units.

7. The cigarette of claim 1 wherein the salt additive of the first wrapping material includes calcium carbonate.

8. The cigarette of claim 1 or 7 wherein the salt additive of the first wrapping material includes a water soluble salt.

9. The cigarette of claim 1 wherein the first wrapping material exhibits an inherent air permeability above about 50 CORESTA units.

10. A cigarette comprising (A) a smokable rod including smokable material contained in first and second circumscribing outer wrapping materials; the first wrapping material circumscribing the smokable filler material, and the second wrapping material circumscribing and overwrapping the first wrapping material; the first wrapping material (i) including tobacco material, and (ii) exhibiting an inherent air permeability above about 50 CORESTA units; and the second wrapping material (i) including cellulosic base web and inorganic filler material, (ii) exhibiting an inherent air permeability below about 15 CORESTA units, and (iii) exhibiting a net air permeability above about 40 CORESTA units; and (B) a filter element including a carbonaceous material.

11. The cigarette of claim 10 wherein the smokable material consists essentially of tobacco filler material.

12. The cigarette of claim 10 wherein the second wrapping material exhibits an inherent air permeability below about 5 CORESTA units.

13. A cigarette comprising (A) a smokable rod including smokable material contained in first and second circumscribing outer wrapping materials; the first wrapping material circumscribing the smokable filler material, and the second wrapping material circumscribing and overwrapping the first wrapping material; the first wrapping material including a tobacco material; and the second wrapping material having a cellulosic base web and inorganic filler material; and (B) a filter element including a carbonaceous material.

14. The cigarette of claim 13 wherein the smokable material consists essentially of tobacco filler material.

15. The cigarette of claim 13 wherein the second wrapping material exhibits an inherent air permeability below about 8 CORESTA units.

16. The cigarette of claim 13 wherein the first wrapping material includes an inorganic salt additive.

17. The cigarette of claim 13 wherein the first wrapping material includes a water soluble salt additive.

18. The cigarette of claim 1, 5, 10, 13 or 16 wherein the first wrapping material includes a carbonaceous material.

19. The cigarette of claim 1, 5, 10 or 13 wherein the filter element includes about 25 mg to about 100 mg of carbonaceous material.

20. The cigarette of claim 1, 5, 10 or 13 wherein the carbonaceous material is in the form of particles.

21. The cigarette of claim 20 wherein the particles of carbonaceous material are dispersed in cellulose acetate tow.

22. The cigarette of claim 1, 4, 10 or 13 wherein the carbonaceous material has a carbon content above about 90 weight percent.

23. The cigarette of claim 1, 5, 10 or 13 wherein the carbonaceous material is activated.

24. The cigarette of claim 1, 5, 10 or 13 wherein the carbonaceous material is an activated coconut hull based carbon.

25. The cigarette of claim 1, 5, 10 or 13 wherein the filter element includes a segment including carbon-containing paper having particles of carbonaceous material therein, the paper being in gathered form.

* * * * *